US005781581A

United States Patent [19]

Fishman et al.

[11] Patent Number: 5,781,581

[45] Date of Patent: Jul. 14, 1998

[54] INDUCTION HEATING AND MELTING APPARATUS WITH SUPERCONDUCTIVE COIL AND REMOVABLE CRUCIBLE

[75] Inventors: Oleg Fishman, Maple Glen, Pa.; Robert C. Turner, Edgewater Park, N.J.

[73] Assignee: Inductotherm Industries, Inc., Rancocas, N.J.

[21] Appl. No.: 629,203

[22] Filed: Apr. 8, 1996

[51] Int. Cl.[6] ..... H05B 6/22

[52] U.S. Cl. ..... 373/152; 373/154; 373/166; 335/216; 219/672

[58] Field of Search ..... 373/151, 152, 373/153, 154, 155, 156, 166, 157, 120; 219/672–677, 162; 252/521; 361/19; 62/63, 51.1; 505/211, 740; 335/216, 300; 209/223.1; 164/122; 165/61; 501/1

[56] References Cited

U.S. PATENT DOCUMENTS

| | | | |
|---|---|---|---|
| 1,802,701 | 4/1931 | Brace . | |
| 2,755,326 | 7/1956 | Kennedy | 13/27 |
| 3,777,368 | 12/1973 | Pfister et al. | 29/599 |
| 4,256,919 | 3/1981 | Berg | 373/166 |
| 4,277,768 | 7/1981 | Burgeson et al. | 335/216 |
| 4,885,273 | 12/1989 | Sugimoto et al. | 505/1 |
| 4,960,760 | 10/1990 | Wang et al. | 505/1 |
| 4,966,884 | 10/1990 | Hilal | 505/1 |
| 5,057,489 | 10/1991 | Ohkawa et al. | 505/1 |
| 5,182,254 | 1/1993 | Owens | 505/1 |
| 5,257,281 | 10/1993 | Cignetti et al. | 373/155 |
| 5,272,720 | 12/1993 | Cignetti et al. | 373/155 |
| 5,379,020 | 1/1995 | Meier et al. | 505/211 |
| 5,416,794 | 5/1995 | Cignetti et al. | 373/155 |
| 5,425,048 | 6/1995 | Heine et al. | 373/151 |
| 5,430,274 | 7/1995 | Couffet et al. | 219/677 |
| 5,512,867 | 4/1996 | Shibuta et al. | 335/216 |

FOREIGN PATENT DOCUMENTS

| | | |
|---|---|---|
| 0 144 559 | 6/1985 | European Pat. Off. . |
| 0 577 468 | 1/1994 | European Pat. Off. . |

*Primary Examiner*—Tu B. Hoang

*Attorney, Agent, or Firm*—Seidel, Gonda, Lanorgna & Monaco, PC

[57] ABSTRACT

An induction heating apparatus having a refractory vessel for holding a quantity of material to be heated by the apparatus. The vessel being surrounded by, but does not touch, an induction coil having a plurality of helical turns. The turns of the induction coil have a surface on which is disposed a layer of high temperature superconducting material.

10 Claims, 4 Drawing Sheets

INDUCTION HEATING AND MELTING APPARATUS WITH SUPERCONDUCTIVE COIL AND REMOVABLE CRUCIBLE

FIELD OF THE INVENTION

The present invention relates to induction heating and melting apparatus, such as for heating and melting metals, and relates particularly to induction ladles which include a removable crucible surrounded by an induction coil.

BACKGROUND OF THE INVENTION

Induction heating apparatus such as induction furnaces or ladles for heating or melting metals operate on the principle of inducing eddy currents in an object (sometimes referred to as the load) to be heated. The eddy currents cause the load to act as its own heat source. Power is generated in the load by resistive heating caused by the eddy currents, according to the well-known $P=I^2R$ heating principle. As used herein, "heating" is used broadly to encompass not only raising the temperature of a material without causing the material to change state, but also melting, wherein the temperature of a material is raised sufficiently to cause it to change state.

In a typical induction furnace, metal to be heated is contained in a crucible, and a generally helical induction coil surrounds the crucible. The induction coil is water cooled. The crucible is usually made of a ceramic refractory material. The eddy currents are induced in the load by passing a high-frequency alternating current through the induction coil to generate a time-varying magnetic field, or induction field. Depending upon the magnitude and frequency of the alternating current in the induction coil, and on other design considerations, the induction field can be used for melting, heating, and/or stirring a quantity of molten metal in the crucible. The induction field can also be used for heat treating workpieces, and for other procedures.

The efficiency of an induction furnace depends, in part, on the amount of energy (in the form of electromagnetic energy) which couples from the induction coil to the load and is converted into heat energy in the load. One overall goal in designing such furnaces is to maximize this efficiency. The efficiency is a function of many different design parameters. One such parameter is the distance between the metal in the crucible and the turns of the induction coil. In conventional induction furnaces, the crucible remains fixed relative to the induction coil, and the ceramic refractory of the crucible is packed against the induction coil to minimize the distance between the coil and the load for a given refractory thickness. This maximizes the coupling between the coil and the load and maximizes the efficiency of the coil. This cannot be done, however, in an induction ladle, where it is desired that the crucible be removable relative to the induction coil to facilitate pouring of molten metal from the induction ladle. In that case, there must be a space between the refractory crucible and the induction coil so that the crucible can be removed without damaging the coil. Of course, the existence of this space reduces the coupling of the magnetic field with the load, making the ladle less efficient than an induction furnace.

In addition, the refractory lining in the ladle may need to be made thicker than the refractory wall of conventional crucibles, since the outer surface of the removable crucible is not cooled by contact with the water-cooled induction coil, as the refractory wall of conventional crucibles would be.

It is desired to provide an induction ladle in which the crucible is removable relative to the induction coil and which is more efficient than conventional induction ladles. This invention provides such a ladle.

SUMMARY OF THE INVENTION

The present invention is an induction heating apparatus comprising a refractory vessel for holding a quantity of material to be heated by the apparatus, the vessel being surrounded by, but not touching, an induction coil comprising a plurality of helical turns. The turns of the induction coil have a surface on which is disposed a layer of high temperature superconducting material.

In a preferred embodiment, the invention comprises an induction coil for generating a time-varying magnetic field. The coil has a plurality of helical turns defining a central axis. A refractory vessel is provided for holding a quantity of metal to be heated by inductive coupling with the magnetic field generated by the coil. The vessel comprises a refractory crucible surrounded by a reinforcing shell, and is disposed coaxially within the induction coil and spaced apart from the coil by a gap so as to be movable along the central axis relative to the induction coil. A layer of high temperature superconducting material is located on the surfaces of the coil turns. A channel within the induction coil turns carries coolant for maintaining the layer of superconducting material at temperatures below the critical temperature of the material.

The invention further comprehends an induction coil for an induction heating apparatus. The coil comprises a hollow core through which a cooling medium may flow, a layer of high-temperature superconducting material disposed on an outer surface of said hollow core, and at least one layer of electrical and thermal insulation encasing said layer of high-temperature superconducting material. The coil has a plurality of turns defining a helix surrounding a central open region for receiving therein an object to be inductively heated by the coil.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
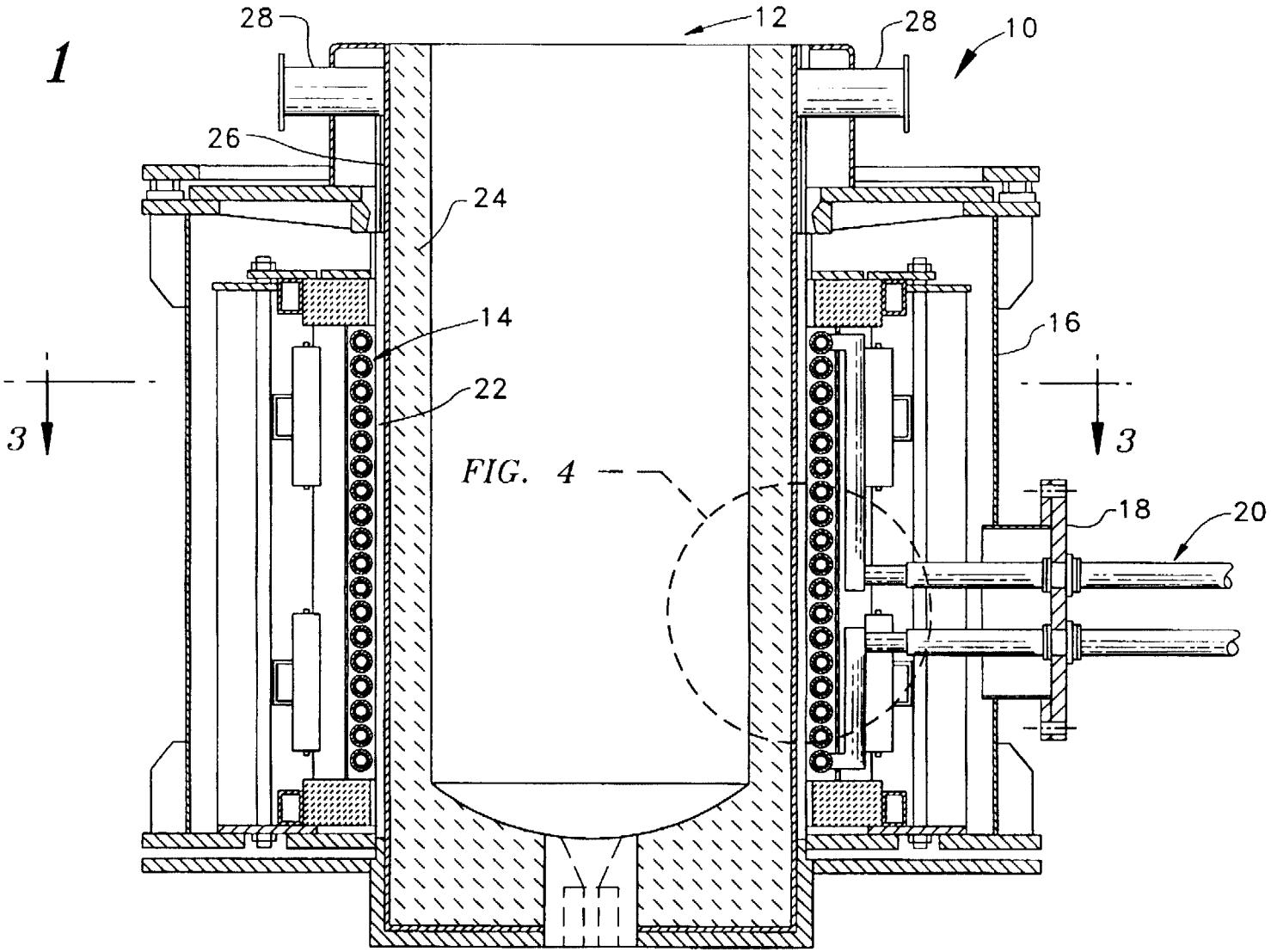
FIG. 1 is an elevational view, in cross-section, of an induction heating apparatus according to one embodiment of the invention.

Referring now to the drawings, wherein like numerals indicate like elements, there is shown in FIG. 1 an induction heating apparatus 10 according to one embodiment of the present invention. Apparatus 10 comprises a refractory vessel 12 for holding material, such as metal, to be heated or melted by the apparatus and a helical induction coil 14 surrounding vessel 12. Induction coil 14 will be described in greater detail below. Induction coil 14 is contained within a housing 16, which is known in the art. Housing 16 is provided with flanges 18 which support the ends 20 of coil 14 through which a cooling medium is supplied to the coil. Electrical connections to coil 14 are not shown, but are known in the art. Coil 14 is excited by a high-frequency alternating current and generates a time-varying magnetic field which inductively couples with an object to be heated.

Figure 2:
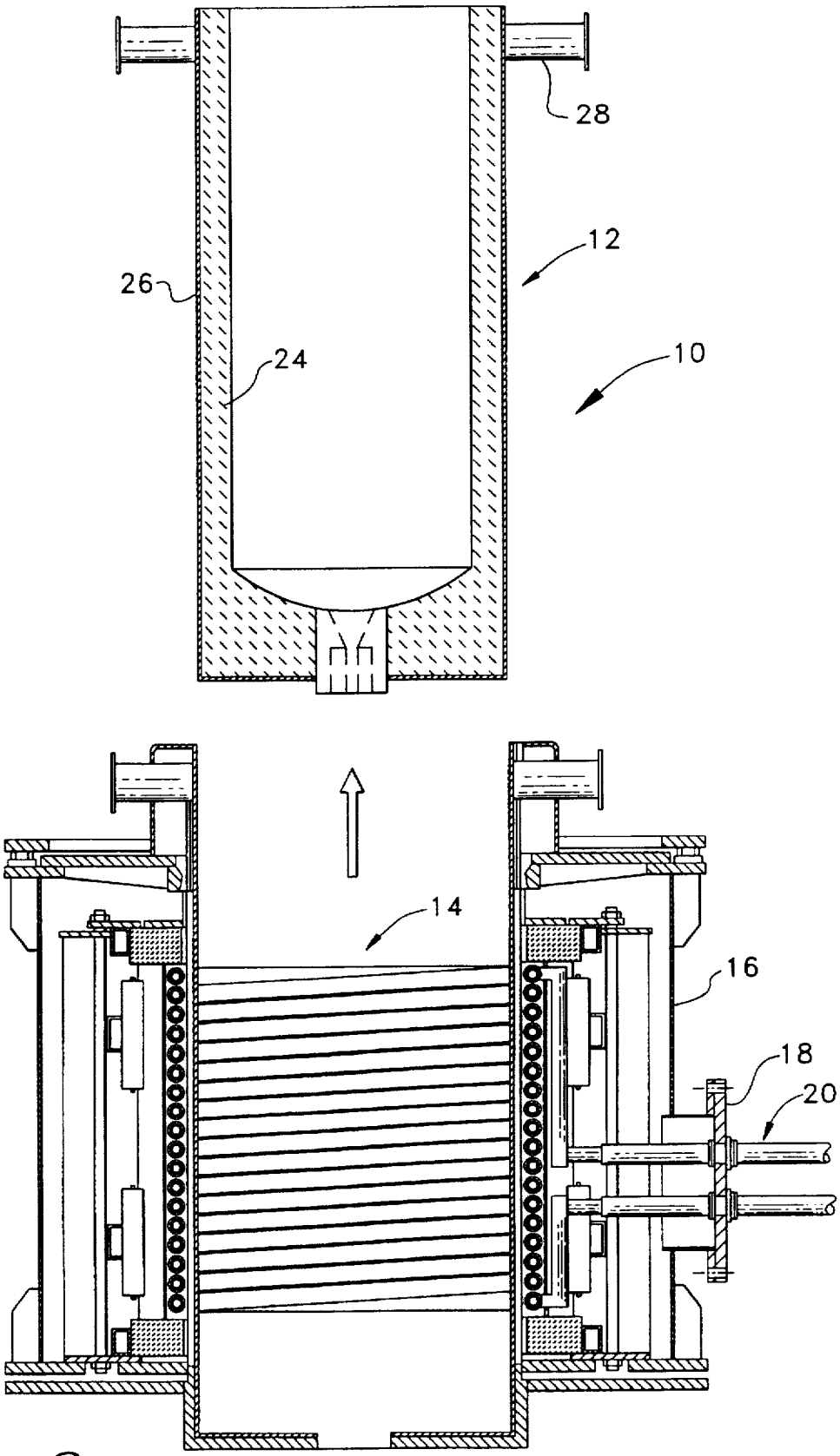
FIG. 2 is an elevational view, also in cross-section, of the induction heating apparatus of FIG. 1, showing the refractory vessel removed from within the induction coil.

Vessel 12 is surrounded by induction coil 14 but is spaced apart from it by a small gap 22. This permits vessel 12 to be removed from within the induction coil, so as to facilitate pouring of molten metal during casting operations, for example. Vessel 12 comprises a refractory lining 24 and a metallic shell 26 which provides mechanical support for the refractory lining. Preferably, shell is constructed of mutually isolated steel strips arranged to from a cylindrical surface which is essentially transparent to the electromagnetic field generated by the induction coil 14. The steel strips are welded to cylindrical flanges at the top and bottom of the vessel. The steel strips are long enough to keep the flanges outside the influence of the magnetic field. Vessel 12 is provided with a pair of trunnions 28 to aid in removing vessel 12 from within induction coil 14. As best seen in FIG. 2, helical induction coil 14 defines an axis, indicated by the shaft of the vertical arrow. Vessel 12 is coaxial with the axis defined by the induction coil and is movable along that axis, as indicated by the head of the vertical arrow, for removal.

Figure 3:
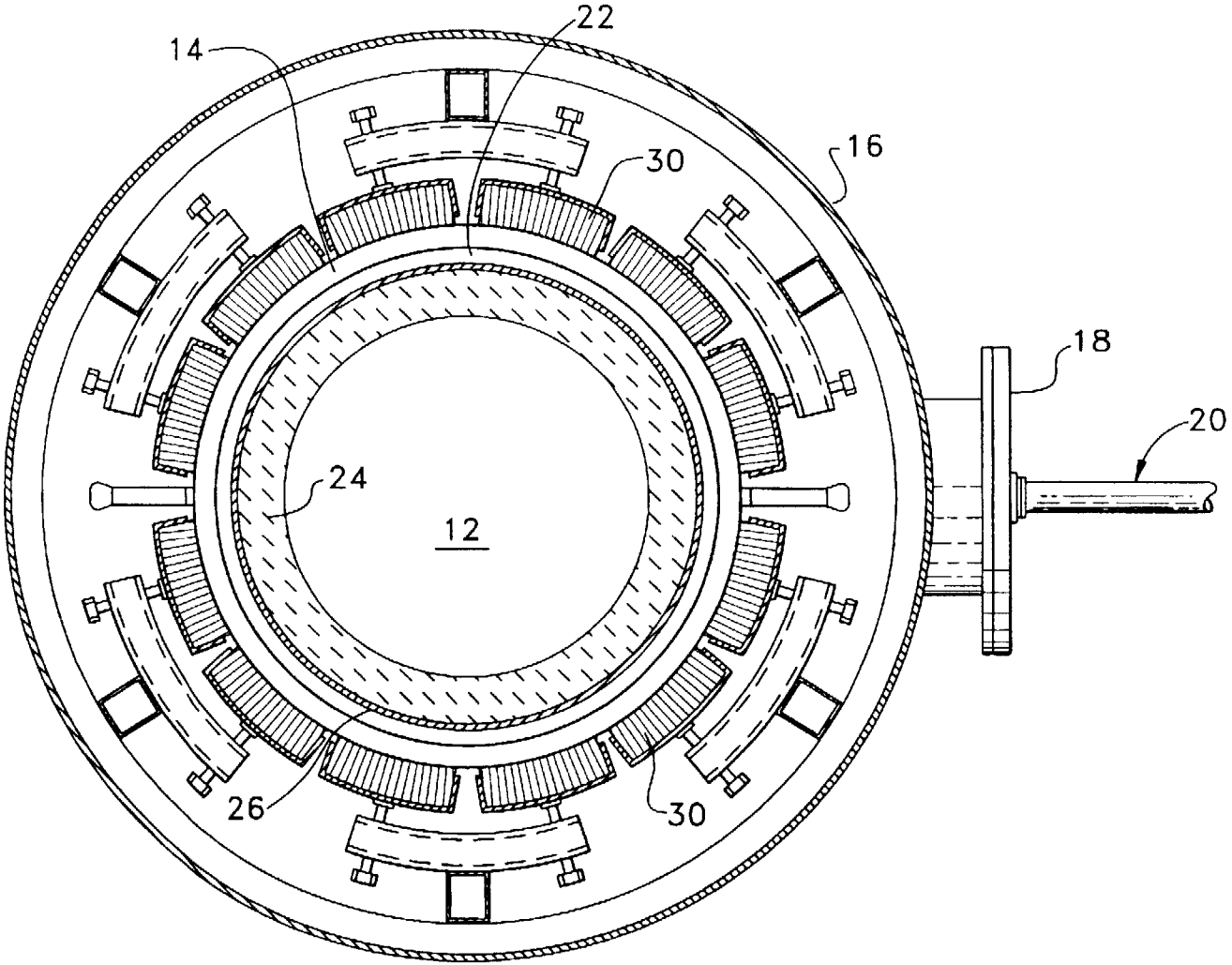
FIG. 3 is a transverse sectional view taken along the lines 3—3 in FIG. 1.
Figure 4:
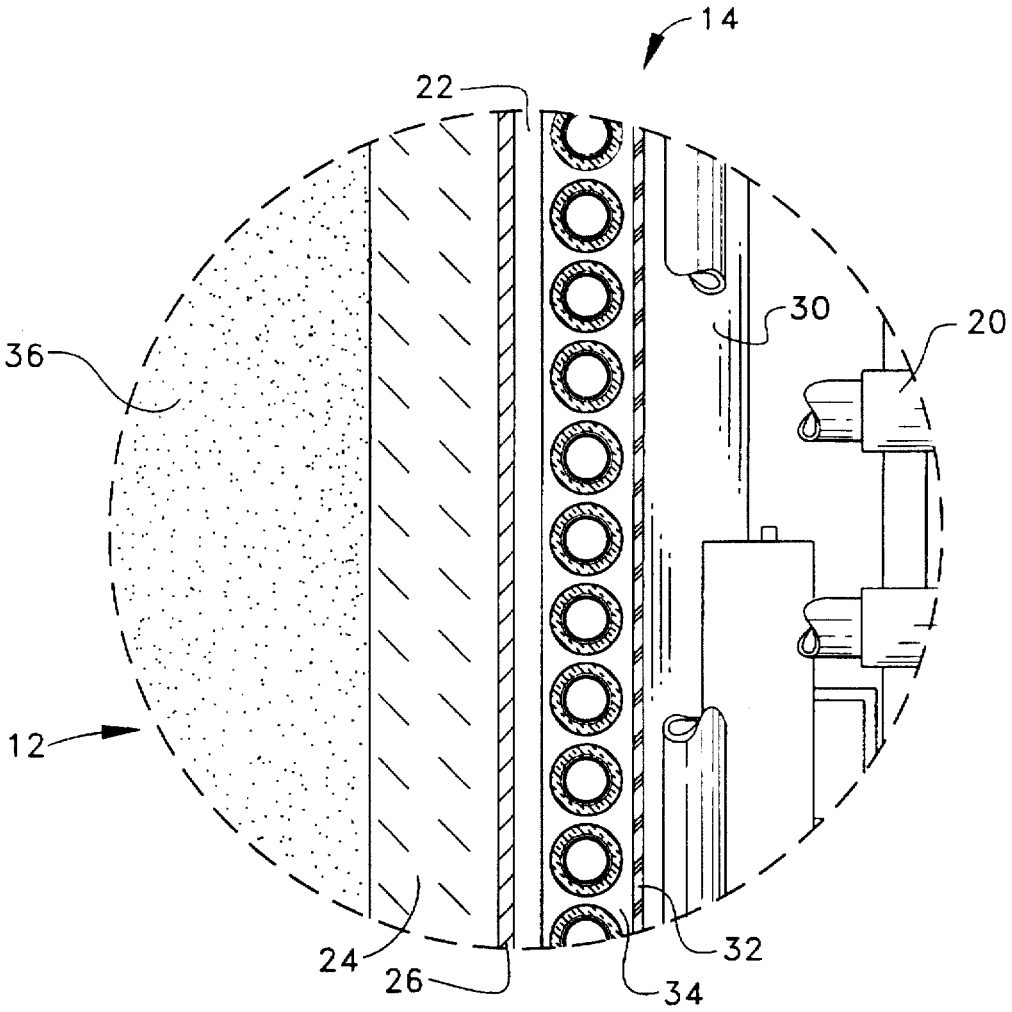
FIG. 4 is an enlarged view of a portion of the apparatus shown in FIG. 1.

Induction coil 14 has associated with it a plurality of yokes 30 to minimize induction of eddy currents into shell 26 of vessel 12. Yokes 30 are best seen in FIGS. 3 and 4, and are separated from induction coil by an electrical insulator 32. More details concerning the yokes and their relationship to induction coil 14 and their function may be had by reference to U.S. Pat. No. 5,416,794, assigned to the same assignee as the present invention. Reference may also be had to related U.S. Pat. Nos. 5,257,281, 5,272,720, and 5,425,048, all assigned to the same assignee as the present invention, for additional details on the construction of the vessel and the coil and yoke assembly. The disclosures of those patents are incorporated herein by reference.

Referring now to FIG. 4, the induction heating apparatus of the invention is shown in greater detail. As can be seen in FIG. 4, and as previously mentioned, the turns of induction coil 14 are spaced from vessel 12 by a small gap 22, so as to permit vessel 12 to be removed from within induction coil 14. The turns of induction coil 14 are also surrounded by thermal insulation 34, to insulate the turns from the heat of molten metal 36 contained within vessel 12. Ordinarily, the presence of the gap 22 reduces the efficiency of the apparatus as compared to an induction furnace where the vessel is not removable, since in the latter case refractory lining 24 can be packed right up against the induction coil 14, leaving a smaller distance between the molten metal 36 and the induction coil 14. The smaller distance enables the magnetic field generated by the induction coil 14 to better couple with the molten metal and, therefore, fewer ampere-turns (i.e., less energy) are required to heat the molten metal 36 inside the vessel.

Figure 5:
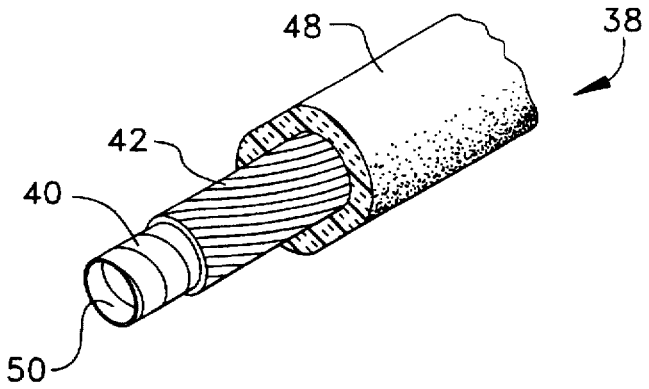
FIG. 5 is a schematic representation of a portion of a coil turn, in section, of the induction coil, showing the structure of the coil in more detail.

The present invention overcomes the reduction in efficiency that would otherwise occur in an induction furnace with a removable vessel by using a high-temperature superconductor layer on a surface of the induction coil. As shown in FIG. 5, which illustrates a portion of an individual turn 38 of induction coil 14, induction coil 14 comprises a tube 40, around the outer circumference of which is disposed a layer 42 of high-temperature superconducting (HTS) material. In the illustrated embodiment, HTS layer 42 comprises individual HTS wires. However, HTS layer 42 may take any form. The entire structure is encased in a flexible insulating sheath 48. A superconducting cable suitable for fabricating induction coil 14 is available commercially from American Superconductor Corp., Westborough, MA.

The high-temperature superconducting material which makes up layer 42 can be any high-temperature superconductor, i.e., any superconductor which has a critical temperature (the temperature below which superconductivity occurs) around 77° K. The layer 42 can be quite thin, since the depth of penetration of current flowing in the layer is inversely dependent upon the square root of the frequency of the current and directly dependent on the square root of the resistivity of the layer. The depth of penetration of the current is calculated using the formula $$\Delta = 50.3\sqrt{\frac{\rho}{f}} \tag{1}$$

where $\rho$, in $\rho\Omega\cdot$cm, is the specific resistivity of the superconductor $f$, in Hertz, is the frequency of the current $\Delta$, in mm, is the depth of current penetration For a superconductor with a typical specific resistivity of 0.001 $\mu\Omega\cdot$cm, and a typical frequency of 300 Hz, the depth of current penetration will be 0.09 mm. Thus, the current can be concentrated in a thin superconducting layer approximately 0.1 mm thick, and can support a current density of 1000 A/mm·square.

Hollow core 40 has a fluid flow channel 50 therein through which a suitable coolant, such as liquid nitrogen, may be supplied in order to keep the HTS layer 42 below the critical temperature. In addition to the layers 48 of electrical and thermal insulation, the induction coil 14 is preferably further insulated from the heat of the molten metal in vessel 12 by thermal insulation 34, as noted above. Moreover, the gap 22 between the induction coil 14 and the vessel 12 also minimizes conduction of heat from the vessel to the coil. Thus, introduction of external thermal energy into the superconductor layer is minimized.

Yokes 30, previously described, serve not only to minimize induction of eddy currents into shell 16 of vessel 12, but also to direct the magnetic field generated by induction coil 14 around the coil itself, so that the field does not couple back into the coil and potentially exceed the critical field of the superconductor material. Exceeding the critical field will cause the superconductor material to become "normal," i.e. to cease to be superconducting.

Using a layer of high-temperature superconducting material such as HTS layer 42 allows high current flow without significant losses. For example, a two-megawatt system will have coil losses of about 300 W. This overcomes the lower efficiencies of an induction heating apparatus with a removable vessel which, as hereinbefore explained, has lower coupling between the coil and the molten metal than an induction heating apparatus which does not have a removable vessel. Losses in a typical, non-superconducting induction furnace are on the order of twenty percent of total applied power, whereas the present invention reduces losses to a level of about 0.15 percent.

Use of a high-temperature superconducting induction coil in an induction furnace which does not have a removable vessel is not practical, since the heat conducted from the molten metal through the refractory will raise the temperature of the superconductor above its critical temperature.

The amount of liquid nitrogen required to remove that heat will be on the order of fifty times higher than the amount required with the present invention, rendering the process uneconomical. The present invention, on the other hand, minimizes thermal conduction transfer of heat from the molten metal to the induction coil, so less coolant is required.

An additional benefit of a high-temperature superconducting induction coil cooled by liquid nitrogen is the elimination of water as a cooling medium. This eliminates the danger of water penetration into molten metal and the violent eruptions associated with such penetration. In addition, nitrogen gas may be used to blanket the surface of the molten bath to limit oxidation of the molten metal, a practice often used in foundries.

While the present invention is described for illustrative purposes in the context of an induction ladle for heating and melting metal, it should be understood that the material to be heated can comprise any material susceptible to induced eddy currents, including but not limited to metals.

The present invention may be embodied in other specific forms without departing from the spirit or essential attributes thereof and, accordingly, reference should be made to the appended claims, rather than to the foregoing specification, as indicating the scope of the invention.

We claim:

1. An induction heating apparatus comprising a refractory vessel for holding a quantity of material to be heated by the apparatus, the vessel being surrounded by and spaced apart from an induction coil comprising a plurality of helical turns, the exterior surface of the induction coil is provided with a layer of high-temperature superconducting material.

2. An induction heating apparatus as in claim 1, wherein the induction coil has an internal passageway for permitting a cooling fluid to flow through it.

3. An induction heating apparatus as in claim 1, wherein the vessel is removable relative to the induction coil.

4. An induction heating apparatus as in claim 1, further comprising thermal insulation surrounding the turns of the induction coil.

5. An induction heating apparatus as in claim 4, wherein the thermal insulation is at least partially located between the turns of the induction coil and the vessel.

6. An induction heating apparatus as in claim 1, further comprising a plurality of magnetic yokes surrounding the induction coil.

7. An induction heating ladle comprising an induction coil for generating a time-varying magnetic field, the coil having a plurality of helical turns defining a central axis, a refractory vessel for holding a quantity of metal to be heated by inductive coupling with the magnetic field, the vessel comprising a refractory crucible surrounded by a reinforcing shell, the vessel being disposed coaxially within the induction coil and spaced apart therefrom by a gap so as to be movable along the central axis relative to the induction coil, a layer of high-temperature superconducting material on an outer surface of the induction coil turns, and a channel within the induction coil turns for carrying coolant for maintaining the layer of high-temperature superconducting material at temperatures below the critical temperature of the material.

8. An induction heating ladle as in claim 7, further comprising a plurality of magnetic yokes surrounding the induction coil for directing lines of flux of the time-varying magnetic field into the metal to be heated.

9. An induction coil for an induction heating apparatus, comprising a hollow core through which a cooling medium flows, a layer of high-temperature superconducting material disposed on an outer surface of said hollow core, and at least one layer of electrical and thermal insulation encasing said layer of high-temperature superconducting material, said coil having a plurality of turns defining a helix surrounding a central open region for receiving therein an object to be inductively heated by the coil.

10. An induction coil assembly for generating a magnetic induction field for an induction heating apparatus, comprising an induction coil having a hollow core through which a cooling medium flows, a layer of high-temperature superconducting material disposed on an outer surface of said hollow core, and at least one layer of electrical and thermal insulation encasing said layer of high-temperature superconducting material, said coil having a plurality of turns defining a helix surrounding a central open region for receiving therein an object to be inductively heated by the induction field, and a plurality of magnetic yokes surrounding the induction coil for directing lines of flux of the induction field into the object to be heated.

* * * * *